US010883292B2

(12) United States Patent
Lo

(10) Patent No.: US 10,883,292 B2
(45) Date of Patent: Jan. 5, 2021

(54) RETAINERS

(71) Applicant: Hewlett-Packard Development Company, L.P., Houston, TX (US)

(72) Inventor: Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 178 days.

(21) Appl. No.: 16/093,992

(22) PCT Filed: Aug. 19, 2016

(86) PCT No.: PCT/US2016/047889

§ 371 (c)(1),
(2) Date: Oct. 16, 2018

(87) PCT Pub. No.: WO2018/034675

PCT Pub. Date: Feb. 22, 2018

(65) Prior Publication Data

US 2019/0128031 A1 May 2, 2019

(51) Int. Cl.

| | |
|---|---|
| ***E05C 21/02*** | (2006.01) |
| ***E05C 9/04*** | (2006.01) |
| ***B41J 29/02*** | (2006.01) |
| ***G12B 9/04*** | (2006.01) |
| ***B41J 29/13*** | (2006.01) |

(Continued)

(52) U.S. Cl.

CPC ..... *E05C 9/046* (2013.01); *B41J 29/02* (2013.01); *B41J 29/13* (2013.01); *E05C 9/185* (2013.01); *E05C 19/10* (2013.01); *G12B 9/04* (2013.01); *E05Y 2900/606* (2013.01); *G03G 2221/1654* (2013.01)

(58) Field of Classification Search

CPC .. B41J 29/13; B41J 29/02; G12B 9/04; G12B 9/06; E05C 9/185; E05C 9/046; E05C 19/10; G03G 2221/1654; G03G 21/1633; G03G 21/1623; G03G 21/1619; G03G 21/1647; G03G 21/1638; G03G 21/1695; E05Y 2900/606; E05Y 2900/608; E05D 3/14; E05D 11/1007; E05D 11/10; E05D 15/04

USPC ..... 49/465, 463, 464

See application file for complete search history.

(56) References Cited

U.S. PATENT DOCUMENTS

| | | | |
|---|---|---|---|
| 5,988,906 | A | 11/1999 | Arcaro et al. |
| 6,783,231 | B1 | 8/2004 | Kim |
| 7,580,652 | B2 | 8/2009 | Hatama |

(Continued)

FOREIGN PATENT DOCUMENTS

| | | |
|---|---|---|
| CN | 104553321 | 4/2015 |
| JP | 0211376 | 1/1990 |

(Continued)

OTHER PUBLICATIONS

Kodak User Guide All-in-One Printer, Mar. 2010, <http://www.kodak.com/support/ ~120 pages.

*Primary Examiner* — Chi Q Nguyen

(74) *Attorney, Agent, or Firm* — HP Inc. Patent Department

(57) ABSTRACT

In an example, a retainer may include a first latch, a plunger, a second latch, and a linkage engaging the second latch with the first latch. The plunger may actuate the first latch, and the linkage may actuate the second latch upon the first latch being actuated.

20 Claims, 7 Drawing Sheets

(51) Int. Cl.
*E05C 9/18* (2006.01)
*E05C 19/10* (2006.01)

(56) References Cited

U.S. PATENT DOCUMENTS

| | | | | |
|---|---|---|---|---|
| 8,249,484 | B2 | 8/2012 | Yamaguchi | |
| 8,587,623 | B2 | 11/2013 | Sudo et al. | |
| 9,400,481 | B2 | 7/2016 | Bayerle et al. | |
| 9,996,048 | B1 * | 6/2018 | Keniston | E05D 3/14 |
| 2006/0167356 | A1 * | 7/2006 | Everett | A61B 6/0457 600/407 |
| 2007/0185615 | A1 * | 8/2007 | Bossi | G07F 17/0092 700/244 |
| 2011/0150560 | A1 | 6/2011 | Rudduck et al. | |
| 2012/0105524 | A1 | 5/2012 | Yamamoto | |
| 2012/0247810 | A1 | 10/2012 | Shige | |
| 2015/0098731 | A1 * | 4/2015 | Leemhuis | G03G 15/0865 399/258 |
| 2018/0321189 | A1 * | 11/2018 | Roach | G01N 27/44791 |

FOREIGN PATENT DOCUMENTS

| | | | |
|---|---|---|---|
| RU | 127990 | U1 | 5/2013 |
| WO | WO-1995012302 | A1 | 5/1995 |

* cited by examiner

RETAINERS

BACKGROUND

Imaging devices may perform actions on or with media. Imaging devices may print, scan, copy, or perform other actions on or with the media. Further, imaging devices may transport media throughout the imaging device, imaging devices may have removable panels to provide access to internal portions of the device.

DETAILED DESCRIPTION

Figure 1A:
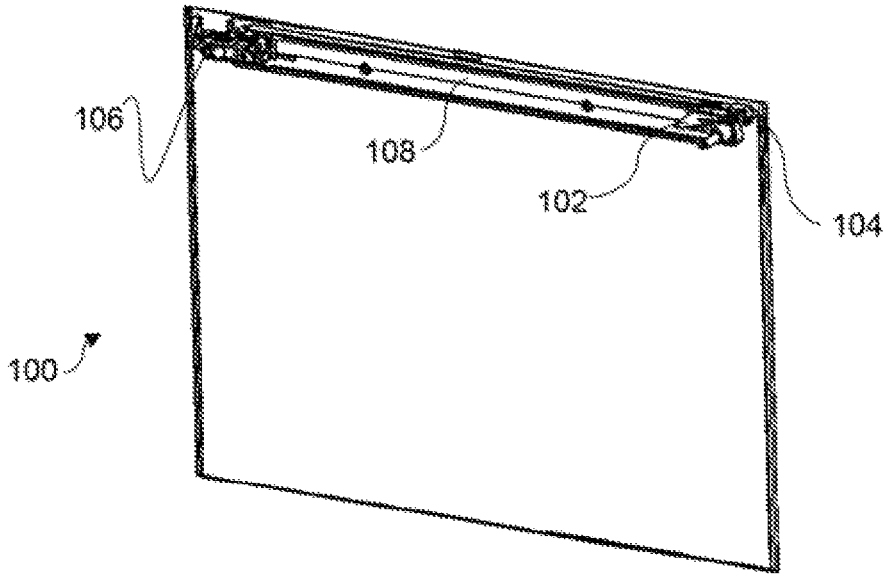
FIG. 1A is a perspective view of an example retainer.

Devices such as imaging devices or other electronic devices, for example, may perform actions on or with media, or a medium thereof. Imaging devices may print, scan, copy, or perform other actions on or with the media. Further, imaging devices may transport media, or a medium thereof, throughout the imaging device, and or through a media path of the imaging device. Devices may include systems, mechanics, assemblies, or other internal components, such as media paths and components thereof, for example, disposed within the device. In some situations, it may be desirable to have the ability to access such internal components or systems for maintenance, repair or replacement of parts, clearing malfunctions or jams, or for other purposes. Devices such as imaging devices or other electronic devices may have removable panels to provide access to internal portions of the device.

In some situations, removable panels may comprise a portion or portions of the exterior housing, case, or body of the device. Such removable panels may be removably attached or assembled to the device. In some situations, the removable panel or panels may be attached to the device using fasteners, such as screws, bolts, pins, or other suitable fastening components. In some situations, the removable panel or panels may be attached to the device using specialty or custom fasteners, clips, snaps, or other specialized components. In further situations, the removable panel or panels may be removable from the device by manually disengaging or unfastening such fasteners from the panel or imaging device, which may be time and or labor intensive. Further, removing the fasteners to remove the panel or panels may involve the use of multiple tools, or specialized tools, in some situations. Additionally, such fasteners may negatively affect the exterior cosmetic appearance of the device.

In further situations, the removable panel or panels may be removable from the device through the actuation of a lever, handle, or other similar exterior component. Such handle or lever may actuate an internal mechanism that may hold the panel on to the device. Such mechanisms may be complex, expensive, and or have many individual components, each subject to malfunction. Further, such an exterior component such as a handle or lever may negatively affect the cosmetic or aesthetic appearance of the device.

Implementations of the present disclosure provide a retainer which may removably attach a panel on to a device, such as an imaging device or other electronic device, for example. Examples of retainers disclosed herein, and the component or components to actuate such retainers, may be disposed internally to the electronic device, thus preserving a favorable exterior cosmetic or aesthetic appearance. Further, examples of retainers disclosed herein may include relatively few components and a relatively simple mechanism for actuation of the retainer. Additionally, examples of retainers disclosed herein may be actuated with minimal tools, or other simple objects.

Figure 1B:
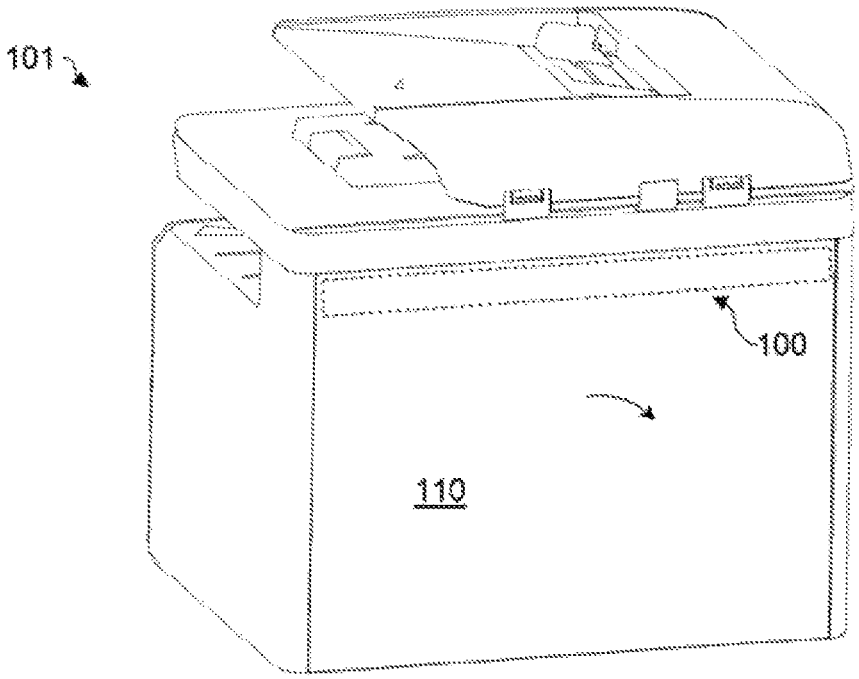
FIG. 1B is a perspective view of an example device having an example retainer.
Figure 1C:
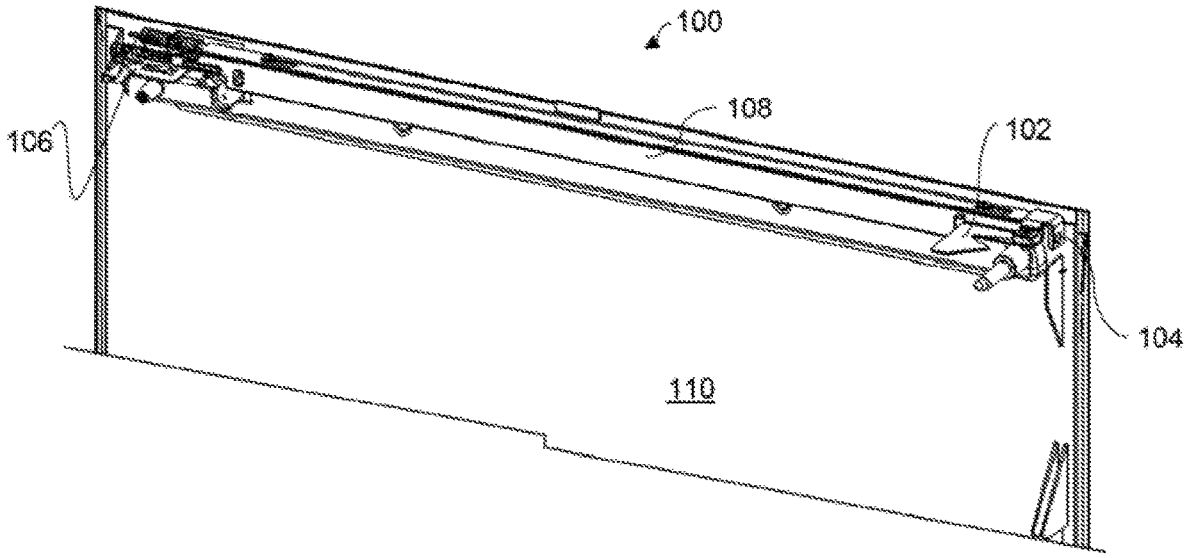
FIG. 1C is a perspective detail view of an example retainer.

Referring now to FIG. 1A, a perspective view of an example retainer 100 is illustrated. In some implementations, the example retainer 100 may include a first latch 102, a plunger 104 to actuate the first latch 102, a second latch 106, and a linkage 108 engaging the second latch 106 with the first latch 102, wherein the linkage 108 may actuate the second latch 106 upon the first latch 102 being actuated. Referring additionally to FIG. 1B, a perspective view of a device 101, or electronic device having an example retainer 100 is illustrated. In some implementations, the device 101 may be an imaging device, or another electronic device in other implementations. Such an imaging device 101 may be a printer, scanner, copier, plotter, three-dimensional (3D) printer, or other imaging device having a housing, case, or other exterior panels. In some implementations, the device 101 may have a panel 110. The device 101 may also have a retainer 100, shown in phantom, disposed on an inside surface of the panel 110, and retaining the panel 110 to the device 101. In further implementations, the panel 110 may be removable from the device 101. For example, in a manner similar to the direction shown in FIG. 1B. Referring additionally to FIG. 1C, a perspective detail view of an example retainer 100 is illustrated. In some implementations, the example retainer 100 may be disposed on the panel 110, which may be a removable panel, in some implementations. In further implementations, the retainer 100 may be disposed on an interior or rear surface or side of the panel 110. The retainer 100 may removably retain the panel 110 to the device 101, and further may release the panel 110 from the device 101 upon actuation of the first fetch 102 and the second latch 106. In yet further implementations, the retainer 100 may be disposed along a first edge of a rear side of the panel 110 of the device 101.

Figure 2A:
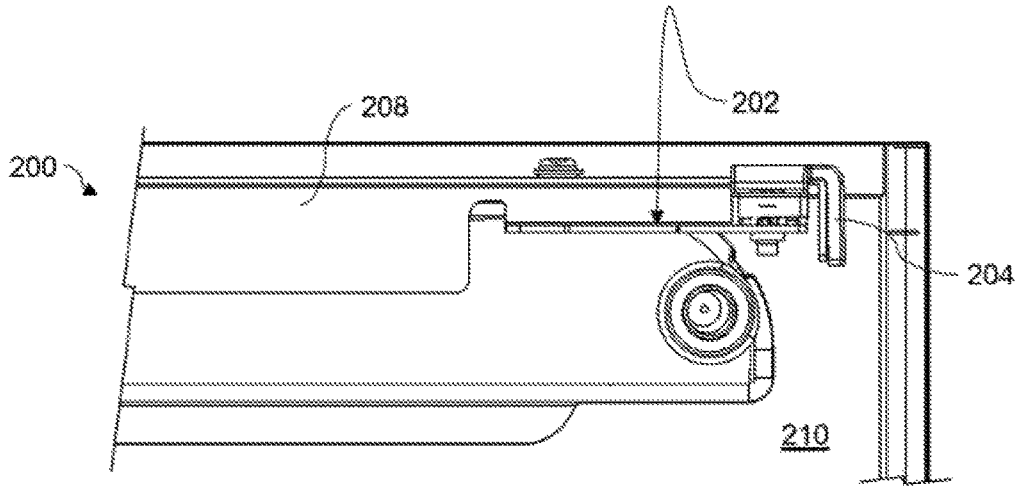
FIG. 2A is a front view of an example retainer.

Referring now to FIG. 2A, a detail front view of an example retainer 200 is illustrated. Example retainer 200 may be similar to example retainer 100. Further, the similarly named elements of example retainer 200 may be similar in function and/or structure to the elements of example retainer 100, as they are described above. In some implementations, the retainer 200 may be disposed on a rear or interior side of a panel 210. In further implementations, FIG. 2A may illustrate a first portion of panel 210, such as a removable panel for example, upon which a first latch 202 of the example retainer 200 may be disposed. The first latch 202 may be movably engaged with the panel 210 so as to removably attach or retain the first portion of the panel 210 to a device, such as an imaging device or other electronic device, for example.

In some implementations, the first latch 202 may be a rigid or semi-rigid member or component of the retainer 200 that may have a suitable geometry to engage with the device, or a component thereof to retain the panel 210, or the first portion thereof, to the device when the first latch 202 is in a latched position, as illustrated in FIG. 2A. In some implementations, the first latch 202 may have a hook-like geometry, or another geometry suitable for allowing the first latch 202 to hook or catch on an interior component of the device such that the first latch 202 retains the panel 210 to the device when the first latch 202 is in the latched position. In further implementations, the first latch 202 may be movable relative to the panel 210. In further implementations, the first latch 202 may be slidable relative to the panel 210. In yet further implementations, the first latch 202 may be able to slide relative to the panel 210 in a direction that is along, or substantially parallel to the panel 210. Further, the first latch 202 may be able to slide relative to the panel 210 in direction that is lateral to the direction along which the removable panel is removable from the device.

Figure 2B:
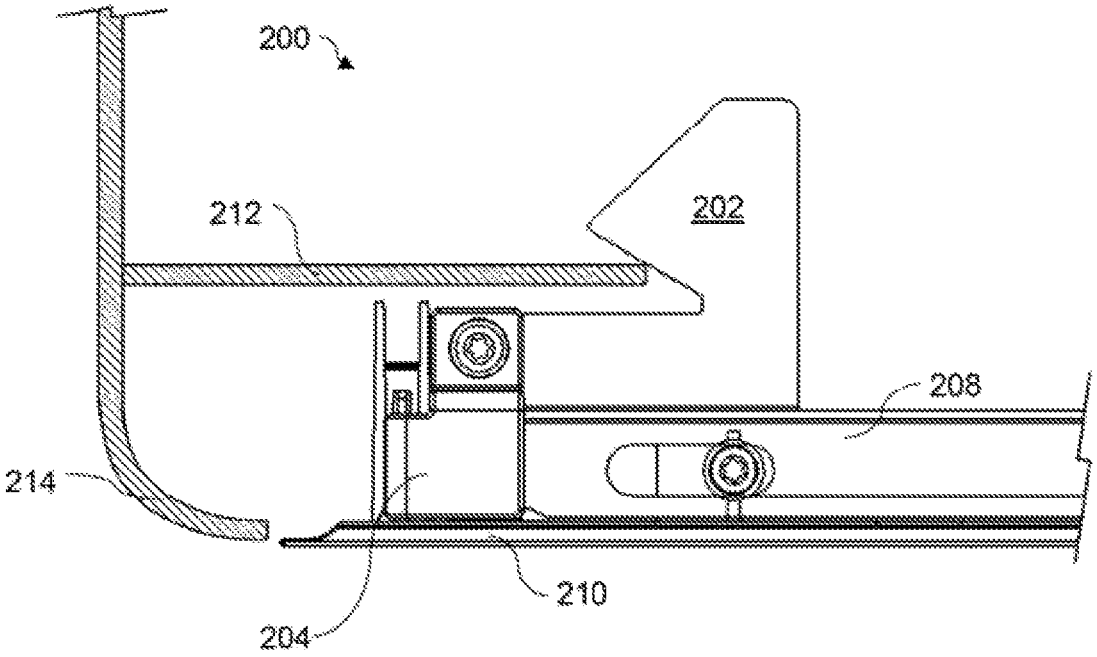
FIG. 2B is a top detail view of an example retainer.

Referring additionally to FIG. 2B, a top view of example retainer 200 is illustrated wherein the first latch 202 is disposed in the latched position. The device to which the retainer 200 may removably attach the panel 210 may include an exterior wall, case panel, or another portion of a housing 214. In some implementations, the housing 214 may abut against or mate with an edge or edges of the panel 210, such that the panel 210 and the remainder of the housing 214 form a portion of or a complete exterior body of the device. In further implementations, the device may include an interior ledge 212 that may engage with the first latch 202 of the retainer 200. The interior ledge 212 may be a rigid or semi-rigid fixed component of the device. The interior ledge 212 may be fixed relative to the first latch 202, in some implementations. The first latch 202, when engaged with the interior ledge 212, may pull the panel 210 against the device so as to securely retain or attach the panel 210, or the first portion thereof in some implementations, to the device. Note, the interior ledge 212 may have a different structure or geometry than illustrated, and, further, the interior ledge may attach to the device, the housing 214, or another component therein in a different manner than illustrated in the Figures.

In some implementations, the example retainer 200 may include a plunger 204 to actuate or move the first latch 202 relative to the panel 210 from the latched position to a released position. The plunger 204 may be a component that is rigidly connected to the first latch 202, in some implementations, or, in other implementations, the plunger 204 may be movable relative to the first latch 202 such that such movement of the plunger 204 may actuate the first latch 202. Further, the plunger 204 may be rigidly or semi-rigidly engaged with the first latch 202, such that actuation or movement of the plunger 204 may be transmitted by the plunger 204 or other intermediary components into actuation of the first latch 202. The plunger 204, in some implementations, may be a separate component that is assembled on to or attached to the first latch 202. In other implementations, the plunger 204 may be a unitary part of the first latch 202. In some implementations, the plunger 204 may be actuated by being pushed upon such that the plunger 204 slides or moves relative to the panel 210. The plunger 204 may transfer such movement or sliding into movement or sliding of the first latch 202 to actuate the first latch 202.

Figure 2C:
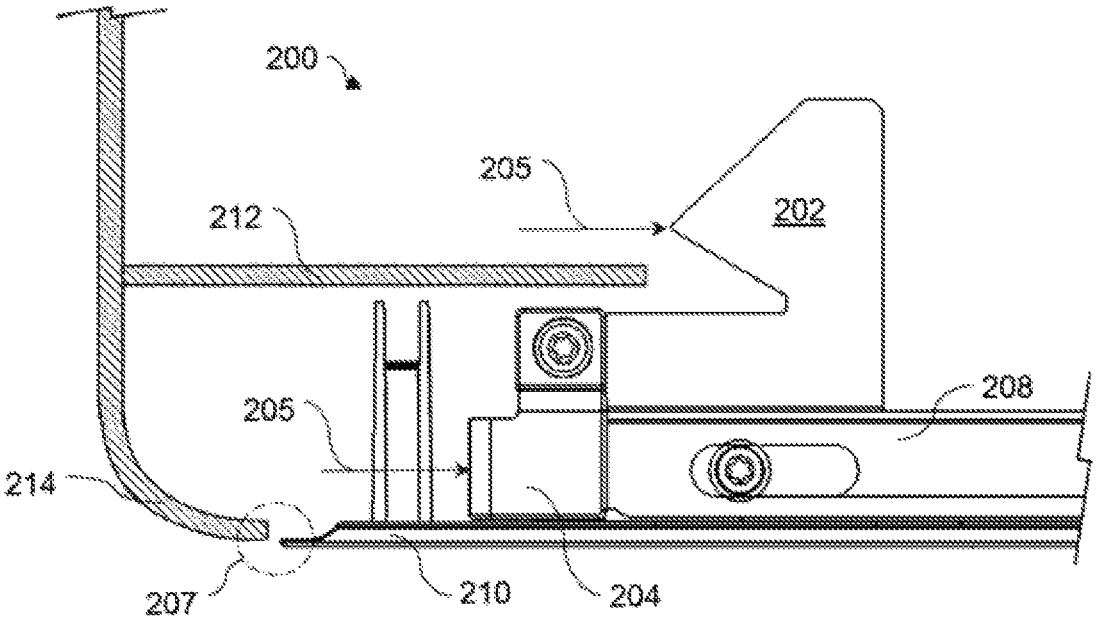
FIG. 2C is a top view of an example retainer.

Referring now to FIG. 2C, a top view of example retainer 200 is illustrated wherein the first latch 202 has been actuated and moved from the latched position to the released position. In some implementations, the plunger 204 may be slidable relative to the panel 210, and rigidly engaged with the first latch 202 such that the first latch 202 is to slide relative to the panel 210 when the plunger 204 is moved in such a fashion. For example, referring to FIG. 2C, the plunger 204 may be slid along direction 205 in order to actuate the plunger 204. Such motion of the plunger 204 may be directly or indirectly transferred into motion of the first latch 202 along direction 205 to move the first latch 202 to the released position. The plunger 204, and thus the first latch 202, may be slid along direction 205 to such a degree that the first latch 202 disengages, or unhooks, in some implementations, from the interior ledge 212. Upon disengaging from the interior ledge 212, the first latch 202 may be disposed in the released position and may no longer hold or retain the panel 210, or the first portion thereof, to the device.

In further implementations, the plunger 204 and/or the first latch 202 may be engaged with a linkage 208, such that upon actuation of the plunger 204 and or the first latch 202, the linkage is also moved. In further implementations, the linkage 208 may be rigidly or semi-rigidly fastened or attached, in either a direct or indirect manner, to the first latch 202 and or the plunger 204 in order to facilitate movement of the linkage 208 upon the first latch 202 being moved.

In some implementations, a gap or recess 207 may exist in between an edge of the panel 210 and the housing 214. In other implementations, the gap 207 may be located elsewhere on the panel 210 and or the housing 214. In order to actuate the plunger 204, and thus the first latch 202, an object or tool having suitable structure or geometry to fit through the gap 207 may be inserted through the gap and press against or otherwise engage with the plunger 204. In further implementations, the gap 207 may be a small crack or seam in between the panel 210 and the housing 214, and the object or tool may have a slender or other suitable geometry to fit through the crack or seam. In yet further implementations, the object or tool may be a common object, such as a screwdriver, pen or other writing utensil, or a credit card, identification card, or other common object having a suitable geometry to fit through the gap 207. In some implementations, such an object or tool may be inserted through the gap 207 by a user or by another external mechanism. Thus, the first latch 202 of the retainer 200 may be actuated while maintaining a clean and positive external cosmetic appearance of the panel 210 and/or the housing 214.

In some implementations, the panel 210 may include an indicator on an exterior side or front side of the panel 210. The indicator may be disposed on a side of the panel 210 that is opposite to the side upon which the retainer 200 is disposed. In other implementations, the indicator may be disposed on an exterior surface of another portion of the housing 214. The indicator may be a hash mark, line, indent or other cosmetic feature, in some implementations. Further, the indicator may indicate or identify the location of the plunger 204 on the rear side of the panel 210, such that a user or another external mechanism may know where along the gap 207 to insert the object or tool to actuate the plunger 204.

Figure 3A:
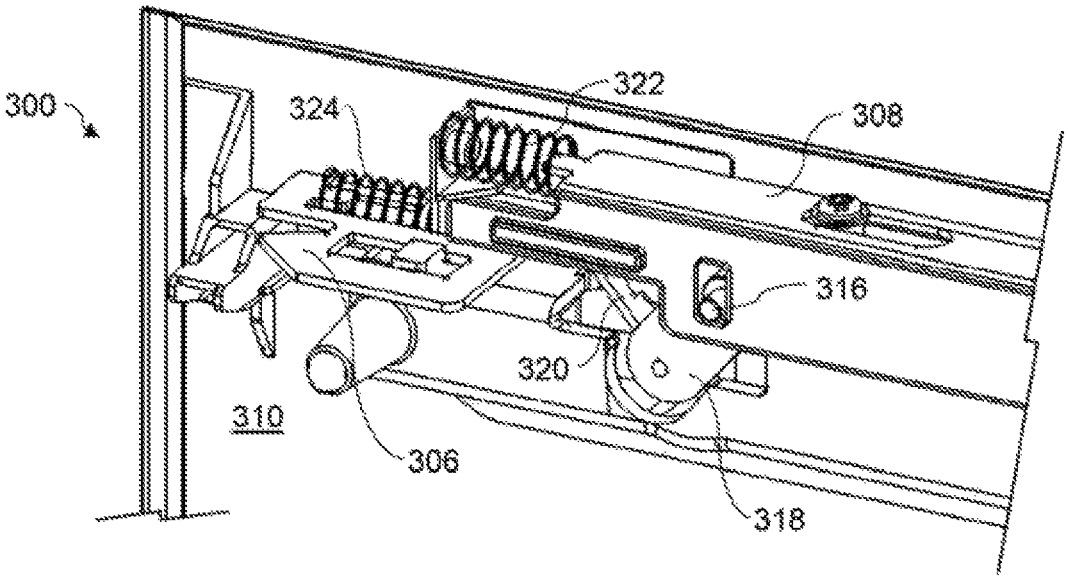
FIG. 3A is a perspective detail view of an example retainer.
Figure 3B:
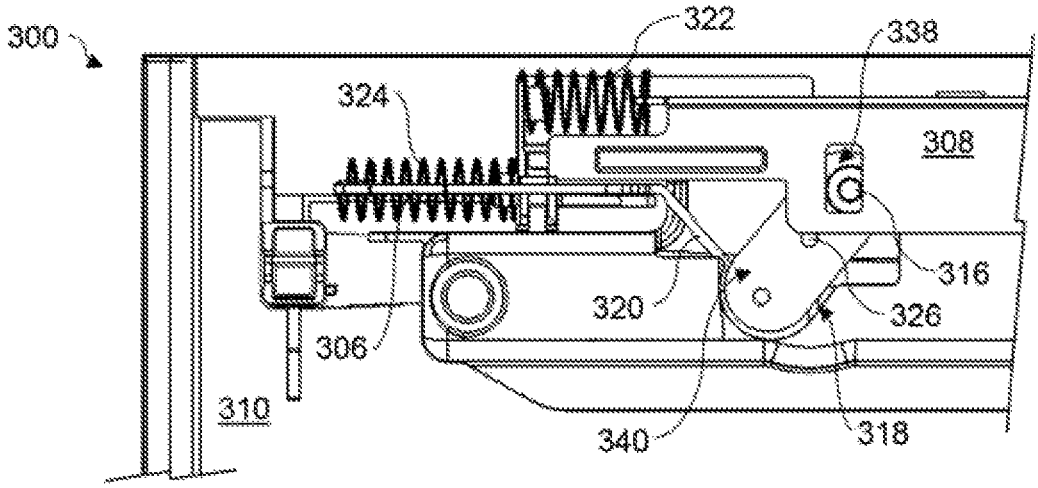
FIG. 3B is a front detail view of an example retainer.

Referring now to FIG. 3A, a perspective view of an example retainer 300 is illustrated. Example retainer 300 may be similar to other example retainers described herein. Further, the similarly named elements of example retainer 300 may be similar in function and or structure to the elements of other example retainers described herein. Referring additionally to FIG. 3B, a front view of example retainer 300 is illustrated. Example retainer 300 may include a second latch 306, a linkage 308, and a bell crank 318, in some implementations. FIG. 3A may illustrate a second portion of a panel 310, upon which the second latch 306 of the example retainer 300 may be disposed. The second latch 306 may be movably engaged with the panel 310 so as to removably attach the second portion of the panel 310 to a device, such as an imaging device. In some implementations, the second latch 306 may be similar in structure and/or function to a first latch of the retainer 300. The second latch 306 may be illustrated as being disposed in a latched position, sometimes referred to as a second latched position, in FIGS. 3A-B, thereby retaining the panel 310, or the second portion thereof, to the device.

In some implementations, the linkage 308 may be a rigid or semi-rigid member or beam engaged with the first latch of the retainer 300. The linkage 308 may be engaged with the first latch such that, upon the first latch being actuated, the linkage 308 may also be actuated, resulting in a movement of the linkage 308. Such movement of the linkage 308 may then be transferred to the bell crank 318 such that the bell crank 318 may pivot to actuate or move the second latch 306. In other words, the bell crank 318 may actuate the second latch 306 upon the linkage 308 moving upon the first latch being actuated.

The bell crank 318 may be a member having a first end 338, a second end 340, and a fulcrum or pivot point 326 disposed at the junction of the first end 338 and second end 340. In some implementations, the pivot point 326 may be disposed in between the first end 338 and the second end 340 such that movement of the first end 338 is transferred by the pivot point 326 to a complementary movement of the second end 340. In further implementations, the linkage 308 may be engaged with the bell crank 318. In some implementations, the first end 338 may be engaged with the linkage 308 such that movement of the linkage 308 is transferred or translated into movement of the first end 338. In other words, upon movement of the first latch to a released position, the linkage 308 may move to actuate the first end 338 of the bell crank 318 to pivot the bell crank 318 such that the second end 340 of the bell crank 318 may actuate or move the second latch 306 relative to the panel 310 from the second latched position to a second released position. In yet further implementations, the bell crank 318 may include a driven pin 316 disposed on the first end 338. The driven pin 316 may be a protrusion or other suitable component to engage with a window, recess, hollow, or other complementary portion of the linkage 308 such that motion of the linkage 308 is transferred to the bell crank 318 through the driven pin 316.

In some implementations, the retainer 300 may include a first bias member 322 to bias the linkage 308, and thus the first latch, towards a latched position of the first latch. Further, the retainer 300 may include a second bias member 324 to bias the second latch 306 towards the second latched position of the second latch 306. The first bias member 322 and the second bias member 324 may each be a resilient component capable of elastic deformation. Thus, the first and second bias members 322 and 324 may each return to their original shape after undergoing a deformation. Such deformation may result in each of the first and second bias members 322 and 324 in exerting a reactive force that may be complementary or proportional to the degree of such deformation. In some implementations, the first and second bias members 322 and 324 may each be compression springs, tension springs, torsion springs, or another type of spring, or may be another suitable resilient component.

Figure 3C:
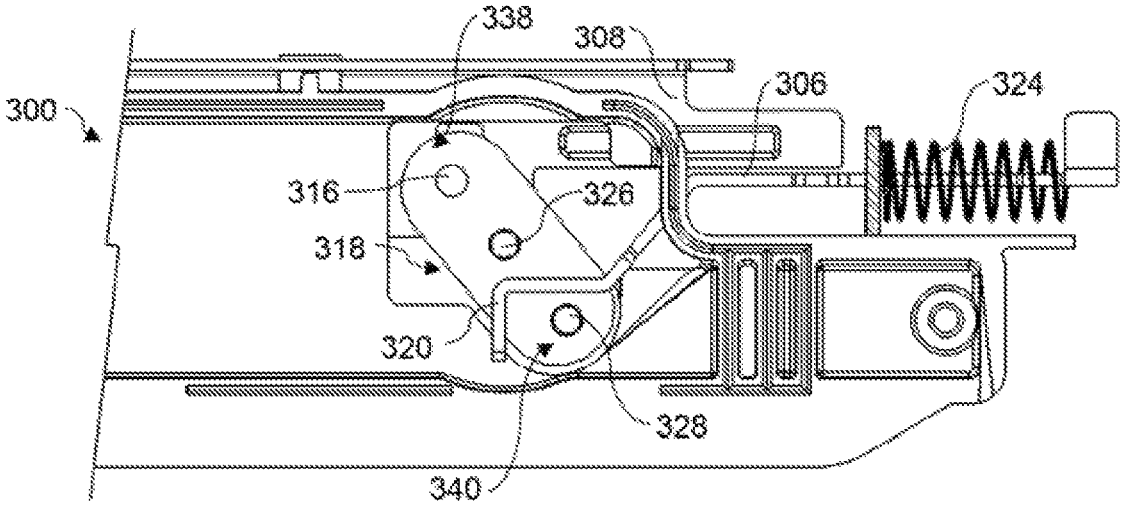
FIG. 3C is a from detail view of an example retainer.

Referring now to FIG. 3C, a back view that may be opposite to the previous front view of the example retainer 300 is illustrated. In some implementations, the bell crank 318 may have a driving pin 328 disposed on the second end 340. The driving pin 328 may engage with a hook 320 of the second latch 306 to actuate the second latch 306, in further implementations. The driving pin 328 may be a pin, post, protrusion, or other suitable component to engage with the hook 320. Similarly, the hook 320 may a J- or L-shaped hook, have a bent geometry, or have another suitable geometry capable of transferring motion of the bell crank 318, and thus the driving pin 328, to the second latch 306. The hook 320, in some implementations, may be a unitary portion of the second latch 306, or may be a separate component that may be assembled or attached to the second latch 306 in other implementations. Note, although the book 320 and the driving pin 328 are illustrated as having a hook and post engagement, each of the hook 320 and the driving pin 328 may have another geometry or structure that is complementary to the other and is capable of transferring motion from the bell crank 318 to the second latch 306.

As illustrated in FIG. 3C, the driving pin 328 may be spaced apart from the hook 320, in some implementations, when the first latch and the second latch 306 are disposed in the respective latched positions. Thus, a lost motion interaction may occur, in some implementations. In other words, the first latch may partially move towards the released position, thus also causing the linkage 308 to partially pivot the bell crank 318 before the driving pin 328 contacts the hook 320 and starts to move the hook 320. Therefore, the driving pin 328 may engage with the hook 320 after the first latch has moved a predetermined distance. In other implementations, however, such a space between the driving pin 328 and the hook 320 may not be present, and therefore the lost motion interaction may not be present and the second latch 306 may move towards the second released position as soon as the first latch moves towards the released position.

Figure 3D:
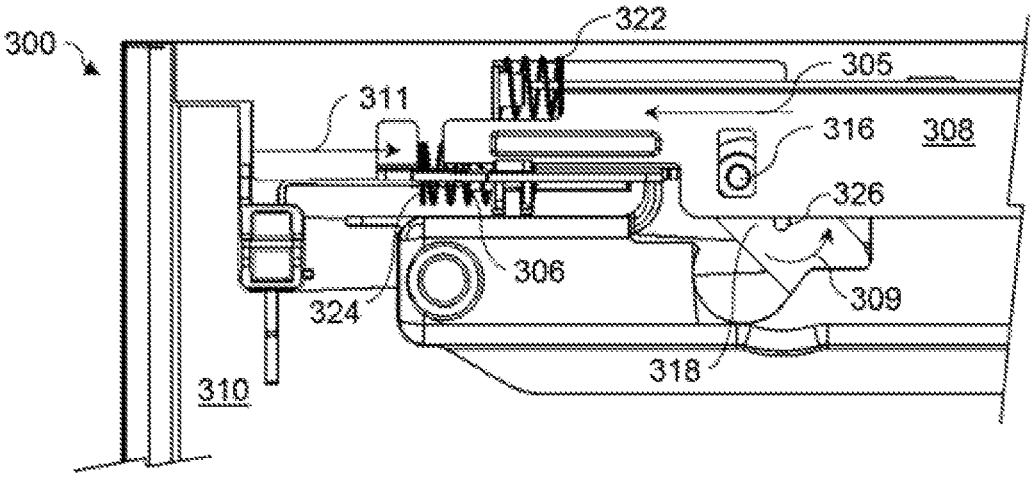
FIG. 3D is a front detail view of an example retainer.
Figure 3E:
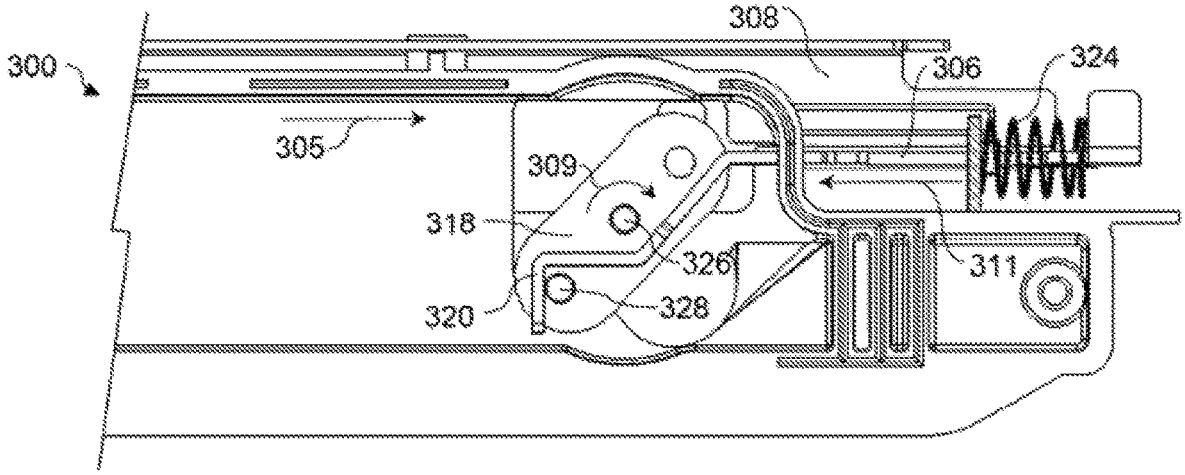
FIG. 3E is a from detail view of an example retainer.

Referring now to FIGS. 3D-E, a front and opposite back view of the example retainer 300 is illustrated wherein the second latch 306 has been moved from the second latched position to the second released position. In some implementations, the first latch may be actuated to move the first latch from a latched position to a released position. Throughout such movement of the first latch, and by way of the engagement of the linkage 308 with the first latch, the linkage 308 may move in a similar direction, for example, along direction 305. The movement of the linkage 308 along direction 305 may cause the bell crank 318 to pivot, rotate, or otherwise move in a complementary manner. In some implementations, the movement of the linkage 308 may cause the bell crank 318 to pivot about pivot point 326 along direction 309. Such movement of the bell crank 318 may cause the driving pin 328 to engage with the hook 320, and thereby pull the hook in a direction 311. In some implementations, direction 311 may be opposite to direction 305. Such movement of the hook 320 may cause the second latch 306 to also move along direction 311. In further implementations, direction 311 may be the direction along which the second latch 306 is to move in order to transition from the second latched position to the second released position.

Figure 3F:
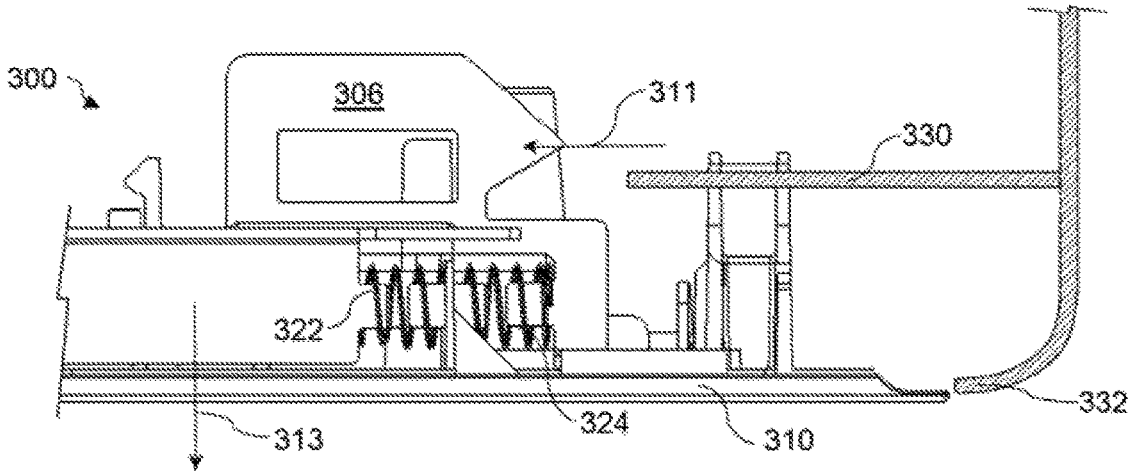
FIG. 3F is a top detail view of an example retainer.

Referring now to FIG. 3F, a top view of example retainer 300 is illustrated wherein the second latch 306 has transitioned to the second released position. The device to which the retainer 300 may removably attach the panel 310 may include an exterior wall, case, panel, or another portion of a housing 332. In some implementations, the housing 332 may abut against or mate with an edge or edges of the panel 310, such that the panel 310 and the remainder of the housing 332 form a portion of or a complete exterior body of the device. In further implementations, the device may include an interior ledge 330 that may engage with the second latch 306 of the retainer 300. Housing 332 may be similar to housing 214, and, in some implementations, may be part of the same overall exterior housing of the device as the housing 214. In some implementations, housing 214 may refer to portions of the exterior housing of the device near the first portion of the panel, while housing 332 may refer to portions of the exterior housing of the device near the second portion of the panel. Similarly, interior ledge 330 may be similar to interior ledge 212 in structure and/or function. In other words, the first latch 202 may engage with interior ledge 212 to removably retain the first portion of the panel to the device. while the second latch 306 may engage with interior ledge 330 to removably retain the second portion of the panel to the device. Thus, the first latch and the second latch may work in conjunction with each other to removably retain the entire panel to the device. Therefore, once the first latch has moved to the released position, and the second latch 306 has moved along direction 311 to the second released position, both latches may be disengaged with the respective interior ledges, and the panel may move along example direction 313 to be removed from the device. In some implementations, direction 313 may be substantially lateral and or orthogonal to the directions along which the first and second fetches move from the respective latched positions to the respective released positions. In other implementations, direction 313 may be oblique to the directions along which the first and second latches travel from the respective latched positions to the respective released positions.

Figure 4:
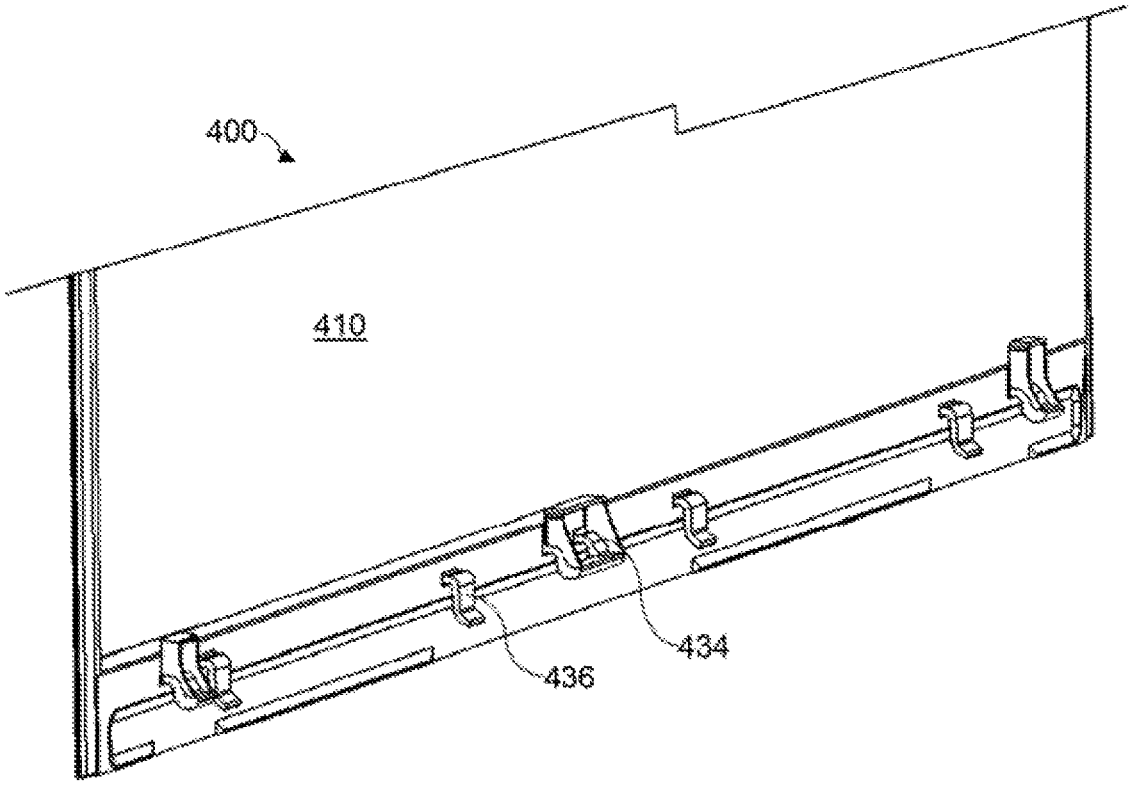
FIG. 4 is a perspective detail view of an example retainer.

Referring now to FIG. 4, a perspective view of an imaging device is illustrated wherein the imaging device may have a removable panel 410 and an example retainer 400 to removably retain the removable panel 410 to the imaging device. Example retainer 400 may be similar to other example retainers described herein. Further, the similarly named elements of example retainer 400 may be similar in function and or structure to the elements of other example retainers described herein. In some implementations, the retainer 400 may be disposed upon an interior side of the removable panel 410 and may include a first latch to removably retain a first portion of the removable panel 410 to the imaging device, and a second latch disposed away from the first latch to removably retain a second portion of the removable panel 410 to the imaging device. Further, the example retainer 400 may include a linkage and a bell crank to engage the second latch with the first latch, wherein the linkage and the bell crank may actuate the second latch upon the first latch being actuated. The first portion and the second portion may be disposed along a first edge of the removable panel 410, in some implementations. The retainer 400 may further include a set of hooks to retain a second edge of the removable panel 410 to the imaging device. In some implementations, the first edge and the second edge of the removable panel 410 may be opposite edges of the removable panel 410, for example, a top edge and a bottom edge. In further implementations the first edge and the second edge of the removable panel 410 may be adjacent edges of the removable panel 410, for example, a top edge and a side edge. In yet farther implementations, the retainer 400 may include a first set of hooks 434 and a second set of hooks 436 to removably retain the second edge of the removable panel 410 to the imaging device, wherein one of the first set or the second set of hooks is to bias the removable panel 410 towards the imaging device.

What is claimed is:

1. An imaging device, comprising:
a retainer, including:
a first latch;
a plunger to move in a first direction to actuate the first latch in the first direction;
a second latch; and
a linkage engaging the second latch with the first latch, the linkage to move in the first direction to actuate the second latch in a second direction opposite the first direction upon the first latch being actuated.

2. The imaging device of claim 1, further comprising a bell crank engaged with the linkage, the bell crank to actuate the second latch upon the linkage moving upon the first latch being actuated.

3. The imaging device of claim 2, wherein, upon actuation of the first latch, the linkage is to move to actuate a first end of the bell crank to pivot the bell crank such that a second end of the bell crank actuates the second latch.

4. The imaging device of claim 3, wherein the bell crank includes a driving pin to engage with a hook of the second latch to actuate the second latch.

5. The imaging device of claim 4, wherein the driving pin is to engage with the hook after the first latch has moved a predetermined distance.

6. The imaging device of claim 1, wherein the retainer is disposed on a rear side of a panel, the retainer to retain the panel to a device and to release the panel from the device upon actuation of the first latch and the second latch.

7. The imaging device of claim 1, wherein the panel includes an indicator on a front side of the panel, the indicator to indicate the location of the plunger on the rear side of the panel.

8. The imaging device of claim 1, further comprising:
a first bias member to bias the linkage and the first latch in a direction opposite the first direction; and
a second bias member to bias the second latch in a direction opposite the second direction.

9. The imaging device of claim 1, wherein:
the first latch is to move in the first direction to transition from a first latched position to a first released position, and
the second latch is to move in the second direction to transition from a second latched position to a second released position.

10. A device, comprising:
a panel; and
a retainer to retain the panel on the device, the retainer including:
a first latch movably engaged with the panel;
a plunger to be actuated in a first direction to move the first latch in the first direction relative to the panel from a latched position to a released position;
a second latch movably engaged with the panel; and
a linkage to be actuated in the first direction upon actuation of the plunger, the linkage engaged with a bell crank to move the second latch in a second direction opposite the first direction relative to the panel from a second latched position to a second released position when the first latch is moved to the released position, the first latch and the second latch to release the panel from the device when the first latch and the second latch are moved to the respective released positions.

11. The device of claim 10, further comprising a first bias member to bias the first latch towards the second latched position.

12. The device of claim 11, further comprising a second bias member to bias the second latch to the latched position.

13. An imaging device, comprising:

a removable panel; and a retainer to removably retain the removable panel to the imaging device, the retainer comprising:

a plunger to move in a first direction to actuate a first latch in the first direction;

a second latch disposed away from the first latch; and a linkage and a bell crank to engage the second latch with the first latch, the linkage to move in the first direction and the bell crank to actuate the second latch in a second direction opposite the first direction when the first latch is actuated such that the first and second latches release the removable panel from the imaging device.

14. The imaging device of claim 13, wherein the first latch is to retain a first portion of the removable panel to the imaging device, and the second latch is to retain a second portion of the removable panel to the imaging device.

15. The imaging device of claim 14, wherein the first portion and the second portion are disposed on a first edge of the removable panel, and the retainer further includes a set of hooks to retain a second edge of the panel to the imaging device.

16. The imaging device of claim 15, wherein the first edge and the second edge of the removable panel are opposite edges of the panel.

17. The imaging device of claim 15, wherein one of the set of hooks is to bias the removable panel towards the imaging device.

18. The imaging device of claim 13, wherein, upon actuation of the first latch, the linkage is to move to actuate a first end of the bell crank to pivot the bell crank such that a second end of the bell crank actuates the second latch.

19. The imaging device of claim 18, wherein the bell crank includes a driving pin to engage with a hook of the second latch to actuate the second latch.

20. The imaging device of claim 19, wherein the driving pin is to engage with the hook after the first latch has moved a predetermined distance.

* * * * *